US006701681B2

(12) United States Patent
Kim

(10) Patent No.: US 6,701,681 B2
(45) Date of Patent: Mar. 9, 2004

(54) DOUBLE GLASS SYSTEM

(75) Inventor: Kwang Soon Kim, Inchon-si (KR)

(73) Assignee: Korea Houghton Corporation (KR)

( * ) Notice: Subject to any disclaimer, the term of this patent is extended or adjusted under 35 U.S.C. 154(b) by 27 days.

(21) Appl. No.: 10/072,513

(22) Filed: Feb. 12, 2002

(65) Prior Publication Data

US 2003/0150174 A1 Aug. 14, 2003

(30) Foreign Application Priority Data

Nov. 2, 2001 (KR) ..... 2001/68293

(51) Int. Cl.[7] ..... E06B 7/00
(52) U.S. Cl. ..... 52/171.3; 359/228; 359/886
(58) Field of Search ..... 52/171.3; 359/228, 359/886

(56) References Cited

U.S. PATENT DOCUMENTS 2,332,060 A * 10/1943 Colleran
2,783,682 A * 3/1957 Swenson
3,174,398 A * 3/1965 Brauner
3,368,862 A * 2/1968 Dean
3,724,929 A * 4/1973 Lacy
3,761,165 A * 9/1973 Besnard
4,093,352 A * 6/1978 Pisar
4,390,240 A * 6/1983 Bookbinder
4,521,077 A * 6/1985 Connelly
4,993,235 A * 2/1991 Frantl
5,231,530 A * 7/1993 Yen
6,216,688 B1 * 4/2001 Schwarz

FOREIGN PATENT DOCUMENTS

FR 2555648 * 5/1985 ..... E06B/3/66

* cited by examiner

*Primary Examiner*—Robert Canfield
(74) *Attorney, Agent, or Firm*—Nathan N. Kallman

(57) ABSTRACT

A double glass system is disclosed in which not only the sunbeams are completely shielded, but also the firefighting is made easier at a fire accident. An incombustible or combustion-resistant liquid with a pigment added therein is used as the solution to be supplied into the double glass. Thus the double glass can shield the sight and the sunbeams, and can serve as a compartment wall, while it is helpful to firefighting at a fire accident, because the solution generates a fire-suppressing gas upon being burned. Thus the functions of the double glass are diversified. Further, an opaque liquid such as mercury is used in place of the solution, so that a sunbeam-shielding effect, a sight blocking effect (to the required degree) and a mirror effect can be obtained. Mercury is supplied into double glass by expanding the mercury and the air by heating them, and therefore, a driving means such as pump is not required. Accordingly, the double glass system is simplified in its constitution, as well as allowing a low cost.

10 Claims, 4 Drawing Sheets

DOUBLE GLASS SYSTEM

FIELD OF THE INVENTION

The present invention relates to a double glass. Particularly, the present invention relates to a double glass system in which not only the sunbeams are completely shielded, but also the firefighting is made easier at a fire accident.

BACKGROUND OF THE INVENTION

Generally, at offices and homes, there are used curtains and blinds so that the sunbeams can be shielded.

However, the curtains and blinds require much installation costs and installation spaces, while they are difficult to wash and replace.

Accordingly, a colored liquid is filled into the interior of the double glass, so that the double glass can perform the functions of the curtain or the blind.

However, in this conventional double glass with the colored liquid inside it, it can serve as a means for shielding the sunbeams and can serve as an interior decoration, but it cannot have any further functions. That is, they do not have other functions, and therefore, they ate limited in the applications.

SUMMARY OF THE INVENTION

The present invention is intended to overcome the above described disadvantages of the conventional techniques.

Therefore it is an object of the present invention to provide a double glass system in which a colored liquid with properties such as non-combustion, combustion resistance and the like is filled into the interior of the double glass so as to shield the sunbeams and so as to make it helpful for the firefighting at a fire accident.

It is another object of the present invention to provide a double glass system in which mercury (which is opaque) is filled into the interior of the double glass, and thus, not only the window serves as a sun beam-shielding means and as a sight shielding means, but also serves as a mirror and as a compartment wall, thereby diversifying the functions of the double glass system.

In achieving the above objects, the double glass system according to the present invention includes: a solution tank for containing a solution to be supplied into the interior of a double glass; a solution pipe connected between the solution tank and the bottom of the double glass, for supplying the solution from the solution tank into the double glass or for discharging the solution from the double glass to the solution tank; an air pipe connected between the solution tank and the upper portion of the double glass, for supplying the air into the interior of the double glass or for discharging the air from the interior of the double glass, a pump installed on the solution pipe, for supplying the solution from the solution tank through the solution pipe into the double glass; an electronic valve installed on the solution pipe, for discharging the solution from the double glass to the solution tank; a control means connected to the pump and the electronic valve, for controlling the pump and electronic valve; and the solution to be filled into the double glass being a non-combustible solvent with a pigment added, or being a combustion-resistant solvent with a pigment added.

The non-combustible solvent is an ester solvent such as trichloroethylene, ethylene, dichloroethylene, perchloroethylene, or the like. The combustion-resistant solvent is a high ignition point low fluidizing silicon oil, or a low viscosity lubricating oil.

In another aspect of the present invention, the double glass system according to the present invention includes: a solution tank for containing a solution to be supplied into the interior of a double glass; a solution pipe connected between the solution tank and the bottom of the double glass, for supplying the solution from the solution tank into the double glass or for discharging the solution from the double glass to the solution tank; an air pipe connected between the solution tank and the upper portion of the double glass, for supplying the air into the interior of the double glass or for discharging the air from the interior of the double glass; a pump installed on the solution pipe, for supplying the solution from the solution tank through the solution pipe into the double glass, and for recovering the solution from the double glass into the solution tank; a control means connected to the pump, for controlling the pump; and the solution to be supplied into the double glass being an incombustible solvent with a pigment added therein, a combustion-resistant solvent with a pigment added therein, or mercury.

In still another aspect of the present invention, the double glass system according to the present invention includes: a solution tank containing a certain amount of mercury to be supplied into a double glass, and containing air over the mercury; a solution supply pipe connected between the solution tank and the bottom of the double glass, for supplying the mercury from the solution tank into the double glass a solution recovery pipe connected between the upper portion of the double glass and the solution tank, for recovering the mercury from the double glass (if the mercury is overfilled in the double glass) into the solution tank; a heat-generating device for generating heat to cause thermal expansions of the mercury the air within the solution tank so as to supply the mercury from the solution tank through the solution supply pipe into the interior of the double glass; a control means connected to the heat-generating device, for controlling heat generations of the heat-generating device; and a key inputting means connected to the control means, for inputting command codes into the control means.

The double glass system according to the present invention fiber includes: a pressure-adjusting valve installed on the solution tank, for adjusting the internal pressure of the solution tank; and a blocking valve installed in the solution recovery pipe, for preventing a reverse flow of the solution from the solution tank.

BRIEF DESCRIPTION OF THE DRAWINGS

The above objects and other advantages of the present invention will become more apparent by describing in detail the preferred embodiments of the present invention with reference to the attached drawings in which.

DETAILED DESCRIPTION OF THE PREFERRED EMBODIMENTS

Now the present invention will be described in detail referring to the attached drawings.

EXAMPLE 1

Figure 1:
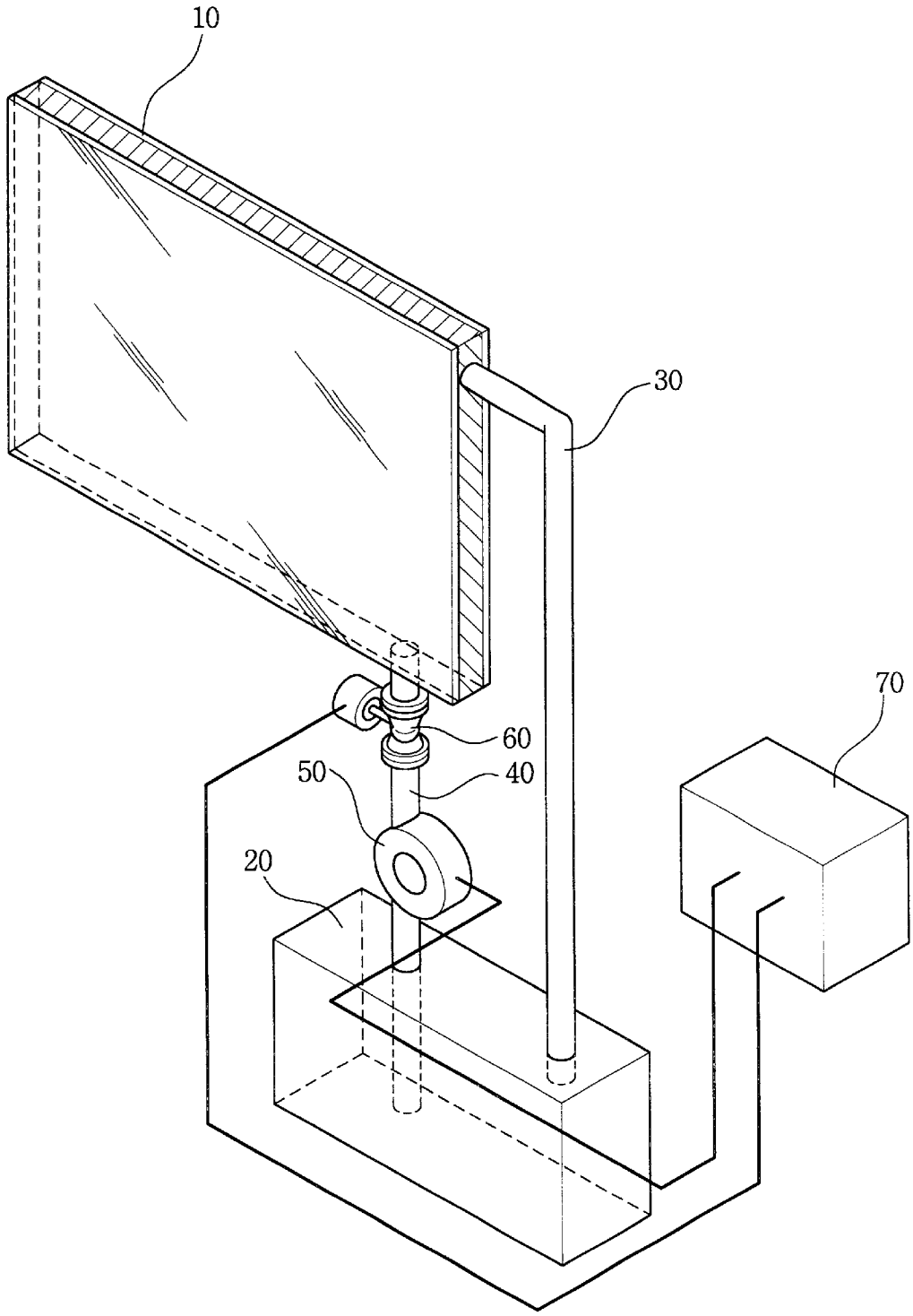
FIG. 1 illustrates the constitution of a first embodiment of the double glass system according to the present invention.

FIG. 1 illustrates the constitution of a first embodiment of the double glass system according to the present invention.

The double glass system according to the present invention includes: a solution tank 20 for containing a solution to be supplied into a double glass 10; an air pipe 30 for discharging the air from within the double glass 10 to the solution tank 20, or for supplying the air into the interior of the double glass 10; and a solution pipe 40 connected between the solution tank 20 and the double glass 10, for supplying the solution from the solution tank 20 into the double glass 10, or for discharging the solution from within the double glass 10 to the solution tank 20.

The air pipe 30 is connected from the solution tank 20 to the upper portion of the double glass 10, for supplying and discharging the air.

The solution pipe 40 is connected from the bottom of the double glass 10 to the solution tank 20, so that the solution can be efficiently discharged from within the double glass 10.

Further, a pump 50 is installed on the solution pipe 40, for supplying the solution from the solution tank 20 through the solution pipe 40 into the double glass 10. Further, an electronic valve 60 is installed for discharging the solution from the double glass 10.

Further, a control part 70 is connected to both the pump 50 and the electronic valve 60 so as to control them.

Under this condition, the double glass 10 is formed by using two glass sheets in such a manner that the two sheets should form a space inside by using a sealing material such as silicon sealant. This is a general type, and therefore, a description on it will be skipped.

In the present invention constituted as described above, the solution tank 20 is filled with a solution, the kind of the solution being dependent on the use of the double glass 10.

For example, in the case where the double glass 10 is used as office windows and compartment walls or as home windows, the following solutions can be used.

That is, there can be used: incombustible or combustion-resistant ethylenic solvent such as trichloroethane (C2H3Cl3), ethylene, dichloroethylene (C2H2Cl2), perchloroethylene (C2Cl4) or the like; or incombustible or combustion-resistant ester solvent such as phosphate ester or the like; a high ignition point and extremely low fluidizing extremely low viscosity silicon oil; a low viscosity lubricating oil; and other combustion-resistant solvents. Pigments are added to these solvents.

One of these solutions is filled into the solution tank 20, and the pump 50 is activated through the control part 70, so that the solution can be supplied from the solution tank 20 through the solution pipe 40 into the double glass 10.

Under this condition, as the solution is supplied into the double glass 10, the air within the double glass 10 is discharged through the air pipe 30 to the solution tank 20.

In the case where the solution consisting of a combustion-resistant solvent with a pigment added therein is filled into the double glass 10, if this double glass 10 is used for a home window, a favorite color can be selected to decorate the interior of home.

The ethylenic and ester incombustible solvent not only is not burned, but also if ignited, it generates a certain gas which suppress the flames. Accordingly, at a fire accident, the double glass is broken, and the solvent is spilled to contribute to quenching the flames.

Further, the combustion-resistant solvents such as the high ignition point extremely low viscosity silicon oil, a low viscosity lubricating oil and the like are not easily burned by fire. Accordingly, at a fire accident, the double glass is broken, and the internal solution flows out to contribute to quenching the flames to some degree.

Meanwhile, in the case where the double glass 10 is used for office windows or for compartment walls, the president or other executives of the company can make their windows or compartment walls shielded or see-through, and therefore, they can watch the company staff. Further, during a meeting, the windows or the compartment walls can be shielded. Further, as described above, the double glass system according to the present invention is helpful in the firefighting at a fire accident.

Under this condition, the firefighting laws have to be considered in using the solvent, and the solvent has to have a low solidification point so that it can be prevented from being freeze-broken.

Meanwhile, if the solution is to be discharged from within the double glass 10, the electronic valve is opened through the control part 70. Thus the solution is discharged from within the double glass 10 through the solution pipe 40 to the solution tank 20. Under this condition, the space which is formed within the double glass 10 by the discharge of the solution is filled with the air through the air pipe 30.

Figure 2A:
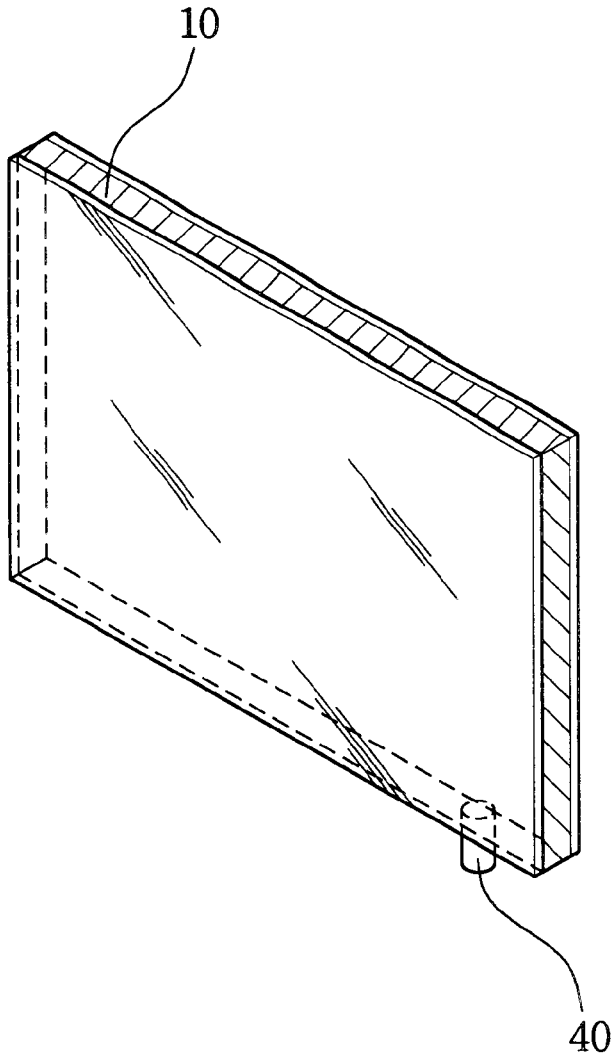
FIGS. 2*a* and 2*b* illustrate the constitutions of the double glass of FIG. 1, in which the solution internally filled within the double glass is made easily discharged.

Under this condition, as shown in FIG. 2*a*, the bottom of the double glass 10 is slightly inclined, with the bottom portion (where the solution pipe is connected) being slightly lower. Therefore, the solution can be easily discharged from within the double glass 10.

Figure 2B:
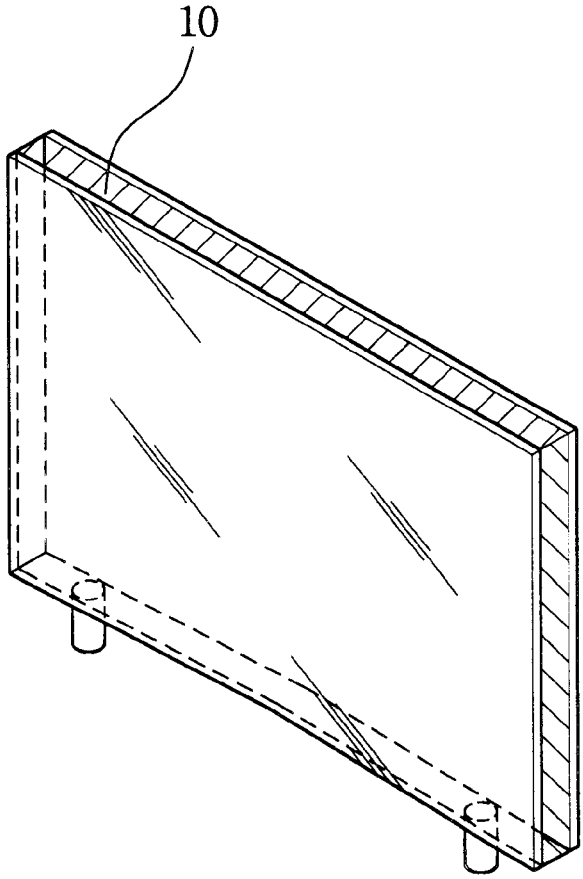

Meanwhile, the two solution pipes can be formed as shown in FIG. 2*b* unlike FIG. 2*a*, so that the solution can be discharged fast from within the double glass 10. In this case, the bottom of the double glass is made convex slightly.

Meanwhile, in the first example of the present invention, if the pump 50 is a de pump (dc-driven pump), the driving direction can be controlled arbitrarily. That is, if the pump 50 is driven forward to supply the solution from the solution tank 20 into the double glass 10, then the pump 50 can be driven reverse to recover the solution from the double glass 10 into the solution tank 20. In this case, the electronic valve 60 is eliminated.

EXAMPLE 2

Figure 3:
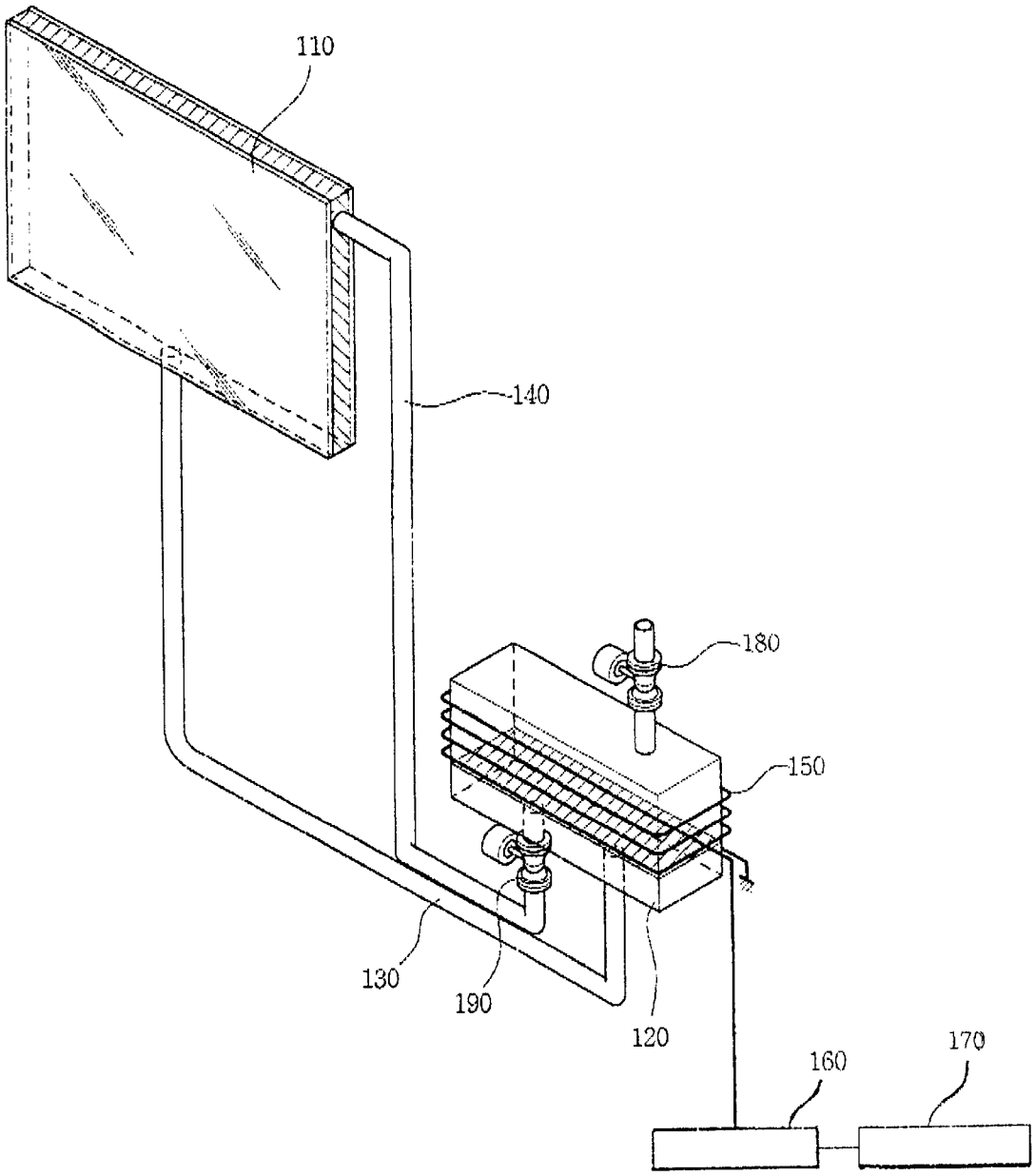
FIG. 3 illustrates the constitution of a second embodiment of the double glass system according to the present invention.

FIG. 3 illustrates the constitution of a second embodiment of the double glass system according to the present invention.

In this second embodiment, the double glass system according to the present invention is constituted as follows. That is, a solution tank 120 contains mercury to be supplied into a double glass 110.

A solution supply pipe 130 is connected from the solution tank 120 to the bottom of the double glass 110, for supplying the mercury from the solution tank 120 into the double glass 110.

Further, a solution recovery pipe 140 is connected from the upper portion of the double glass 110 to the solution tanks 120, for recovering the mercury from within the double glass 110 to the solution tank 120.

Further, there is installed a heat-generating device 150 on the solution tank 120, for generating heat to cause a thermal expansion, so that the mercury can be supplied from the solution tank 120 through the solution supply pipe 130 into the double glass 110.

Further, a control part 160 is connected to the heat-generating device 150, for controlling the heat-generating degree of the heat-generating device 150. Further, a key inputting part 170 is connected to the control part 160, so that command codes can be inputted.

The heat-generating device 150 can be formed by using an electro-heating coil, and this coil can be made to surround the air above the mercury within the solution tank 120, so that the air can be heated.

Or the coil can be made to surround the total of the solution tank 120, so that the air within the solution tank 120 can be heated.

If the size of the double glass 110 is so small as to heat the mercury with a small amount of heat, and thus if the mercury can be expanded enough to fill the double glass 110, then the coil can be immersed in the mercury within the solution tank 120. However, in this case, the coil has to be electrically well insulated, so that the formation of any short circuit can be prevented.

Further, a pressure regulation valve 180 is installed on the solution tank 120. If the internal pressure of the double glass 110 rises to a high level due to a rise of the temperature of the external atmospheric air, then the double glass 110 can be damaged due to the expansion of the mercury and the internal air. Therefore, in order to prevent such a phenomenon, the pressure regulation valve 180 discharges the internal air if the internal pressure rises too much, thereby adjusting the internal pressure of the double glass 110.

Further, a blocking valve 190 is installed on the solution recovery pipe 140, so that a reverse flow from the solution tank 120 to the double glass 110 can be prevented.

In the present invention constituted as described above, an amount of mercury sufficient to fill the whole interior of the double glass 110 is filled into the solution tank 120, while in the vacant space of the solution tank 120, there is filled air. Then the solution tank 120 is completely sealed.

Thereafter, if the mercury is to be filled into the double glass 110, the heat-generating device 150 is activated through the control part 160 so as to generate heat.

Under this condition, if the electro-heating coil of the heat-generating device 150 surrounds the upper inside or outside of the solution tank 120 to heat the internal air of the tank 120, then the internal air of the solution tank 120 is expanded to push the mercury through the solution supply pipe 130 into the double glass 110.

FIG. 3 illustrates the case where the electro-heating coil is wound around the outside of the solution tank 120.

On the other hand, if the electro-heating coil of the heat-generating device 150 surrounds the entire outside of the solution tank 120, then both the mercury and the internal air are expanded, so that the mercury can be supplied into the double glass 110 more efficiently.

Further, if the electro-heating coil of the heat-generating device 150 is immersed in the mercury within the solution tank 120, then mainly the mercury expands so as to be supplied into the double glass 110.

Under this condition, when the mercury is supplied into the double glass 110, the blocking valve 190 of the solution recovery pipe 140 is closed, so that a reverse flow of the mercury through the solution recovery pipe 140 can be prevented.

The blocking valve 190 can be controlled by the control part 160. When the control part 160 activates the heat-generating device 150 to supply the mercury from the solution tank 120 into the double glass 110, the control part 160 closes the blocking valve 190, so that a reverse flow of the mercury from the double glass 110 into the solution tank 120 can be prevented.

Further, when the mercury is supplied into the double glass 110, the heat-generating degree of the heat-generating device 150 can be adjusted with different stages such as strong, medium, weak and off, and thus the mercury height level and the mercury supply speed can be adjusted. This is done by the user through the key inputting part 170 which is connected to the control part 160.

In this manner, if the mercury is completely filled into the double glass 110, and thereafter, if the mercury is subjected to too high a pressure, then the mercury is recovered through the solution recovery pipe 140 into the solution tank 120. That is, this is done because the blocking valve 190 of the solution recovery pipe 140 is opened, if a certain amount of the mercury is accumulated to above a certain limit load.

That is, the supply speed and the height level of the mercury are adjusted with the different stages such as strong, medium and weak, and therefore, the control part 160 has the time by which the mercury is completely filled into the double glass 110 at the different stage settings. Therefore, when the mercury is filled completely into the double glass 110, the blocking valve 190 is automatically closed under the control of the control part 160. Or the blocking valve 190 can also be closed or opened by the manual operation by the user.

In this manner, if the mercury is filled into the double glass 110, then the sunbeams and the sight are completely shielded, because mercury is perfectly opaque. Therefore, the double glass 110 can be used as a compartment wall in an office, and not only so, but the double glass 110 can serve as a mirror.

If the temperature of the external atmospheric air rises too much so as to cause the expansions of the air and mercury too much within the solution tank 120, then the pressure regulation valve 180 is automatically opened to discharge the compressed air of the solution tank 120, thereby preventing any damage of the double glass 110.

Meanwhile, as a measure for the case where the double glass 110 is destroyed by an external impact to make the mercury spilled, a transparent film such as acryl or vinyl film can be coated on the double glass 110. In the case where such a coating is carried out, a heat insulating effect can be promoted.

Mercury is toxic to the human body, and therefore, the double glass system is completely sealed. But care has to be exercised in using it.

In the above, the present invention was described based on the specific preferred embodiments and the attached drawings, but it should be apparent to those ordinarily skilled in the art that various changes and modifications can be added without departing from the spirit and scope of the present invention, which will be defined in the appended claims.

According to the present invention as described above, the following effects can be reaped.

First, an incombustible or combustion-resistant liquid with a pigment added therein is used as the solution to be supplied into the double glass. Thus the double glass can shield the sight and the sunbeams, and can serve as a compartment wall, while it is helpful to firefighting at a fire accident. Thus the functions of the double glass are diversified.

Second, an opaque liquid such as mercury is used in place of the solution, so that a sunbeam-shielding effect, a sight blocking effect (to the required degree) and a mirror effect can be obtained.

Third, in the second embodiment (second example) of the present invention, the mercury is supplied into double glass by expanding the mercury and the air by heating them, and therefore, a driving means such as pump is not required. Accordingly, the double glass system is simplified in its constitution, as well as allowing a low cost.

What is claimed is:

1. A double glass system comprising:

a solution tank for containing a solution to be supplied into an interior of a double glass;

a solution pipe connected between the solution tank and a bottom of the double glass, for supplying the solution from the solution tank into the double glass or for discharging the solution from the double glass to the solution tank;

an air pipe connected between the solution tank and an upper portion of the double glass, for supplying the air into the interior of the double glass or for discharging the air from the interior of the double glass;

a pump installed on the solution pipe, for supplying the solution from the solution tank through the solution pipe into the double glass;

an electronic valve installed on the solution pipe, for discharging the solution from the double glass to the solution tank;

a control means connected to the pump and the electronic valve, for controlling the pump and electronic valve; and the solution to be filled into the double glass being a non-combustible solvent with a pigment added, or being a combustion-resistant solvent with a pigment added.

2. The double glass system as claimed in claim 1, wherein the non-combustible solvent is an ester solvent from the groups comprising trichloroethylene, ethylene, dichloroethylene, perchloroethylene; and the combustion-resistant solvent is a high ignition point low fluidizing silicon oil, or a low viscosity lubricating oil.

3. The double glass system as claimed in claim 1, wherein the double glass has a bottom inclined slightly toward a side where the solution pipe is installed to make the solution more easily discharged.

4. The double glass system as claimed in claim 1, wherein the solution pipe is installed at each end of the bottom of the double glass.

5. The double glass system as claimed in claim 4, wherein the bottom of the double glass is made convex to make it possible to easily discharge the solution.

6. A double glass system comprising:

a solution tank for containing a solution to be supplied into an interior of a double glass;

a solution pipe connected between the solution tank and a bottom of the double glass, for supplying the solution from the solution tank into the double glass or for discharging the solution from the double glass to the solution tank;

an air pipe connected between the solution tank and an upper portion of the double glass, for supplying the air into the interior of the double glass or for discharging the air from the interior of the double glass;

a pump installed on the solution pipe, for supplying the solution from the solution tank through the solution pipe into the double glass, and for recovering the solution from the double glass into the solution tank;

a control means connected to the pump, for controlling the pump; and the solution to be supplied into the double glass being an incombustible solvent with a pigment added therein, a combustion-resistant solvent with a pigment added therein, or mercury.

7. A double glass system comprising:

a solution tank containing a certain amount of mercury to be supplied into a double glass, and containing air over the mercury;

a solution supply pipe connected between the solution tank and a bottom of the double glass, for supplying the mercury from the solution tank into the double glass;

a solution recovery pipe connected between an upper portion of the double glass and the solution tank, for recovering the mercury from the double glass into the solution tank if the mercury is overfilled in the double glass;

a heat-generating device for generating heat to cause thermal expansions of the mercury and/or air within the solution tank so as to supply the mercury from the solution tank through the solution supply pipe into the interior of the double glass;

a control means connected to the heat-generating device, for controlling heat generations of the heat-generating device; and a key inputting means connected to the control means, for inputting command codes into the control means.

8. The double glass system as claimed in claim 7, further comprising: a pressure-adjusting valve installed on the solution tank, for adjusting an internal pressure of the solution tank.

9. The double glass system as claimed in claim 7, further comprising: a blocking valve installed on the solution recovering pipe, for preventing a reverse flow of the solution from the solution tank to the double glass.

10. The double glass system as claimed in claim 7, wherein the heat-generating device consists of an electro-heating coil.

* * * * *